United States Patent [19]

Figge

[11] 4,241,117

[45] Dec. 23, 1980

[54] STRUCTURAL CORES AND THEIR FABRICATION

[75] Inventor: Irving E. Figge, Newport News, Va.

[73] Assignee: The United States of America as represented by the Secretary of the Army, Washington, D.C.

[21] Appl. No.: 48,402

[22] Filed: Jun. 14, 1979

[51] Int. Cl.[3] ..... E04C 3/30; B65H 81/00

[52] U.S. Cl. ..... 428/35; 52/727; 52/731; 52/DIG. 10; 156/172; 156/425; 156/433; 428/377; 428/398

[58] Field of Search ..... 156/172, 175, 169, 166, 156/180, 425, 433, 148, 149; 428/35, 36, 377, 375, 398, 399, 542; 52/DIG. 10, 730, 731, 720, 727

[56] References Cited

U.S. PATENT DOCUMENTS

| | | | |
|---|---|---|---|
| 3,501,880 | 3/1970 | Bosch | 428/542 |
| 3,551,237 | 12/1970 | Cox et al. | 156/175 |
| 3,579,422 | 5/1971 | Minick et al. | 156/169 |
| 3,615,883 | 10/1971 | Palfreyman et al. | 156/169 |
| 3,642,566 | 2/1972 | Figge | 156/196 |
| 3,645,833 | 2/1972 | Figge | 156/169 |
| 3,657,059 | 4/1972 | Figge | 156/174 |
| 3,689,345 | 9/1972 | Fiss et al. | 156/245 |
| 3,772,126 | 11/1973 | Myers | 156/180 |
| 3,813,273 | 5/1974 | Loustau | 156/201 |

*Primary Examiner*—Michael W. Ball

*Attorney, Agent, or Firm*—Nathan Edelberg; Robert P. Gibson; Norman L. Wilson, Jr.

[57] ABSTRACT

Structural cores in the form of open-ended polyhedrons joined together along common edges or sides are generating high industrial interest because of the great strengths they possess relative to their weights. A structural core medium of interwoven fibrous filaments coated with plastic is highly satisfactory, but it has the disadvantage that it is very difficult, if not heretofore impossible, to produce in other than planar, sandwich or cylindrical form. A jig for the fabrication of such cores has not come into existance. This invention provides a jig which makes possible the fabrication of such polyhedral structural cores.

15 Claims, 10 Drawing Figures

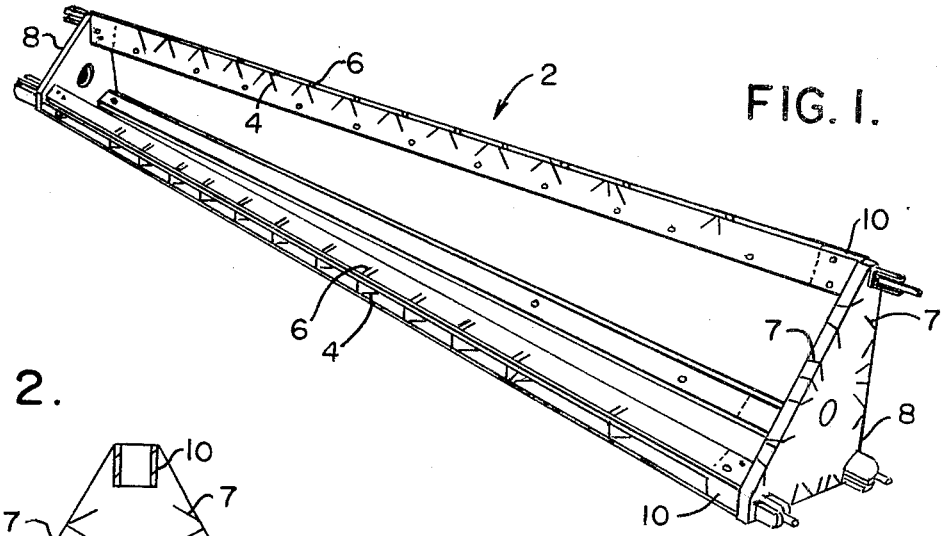
FIG. 1.
FIG. 2.
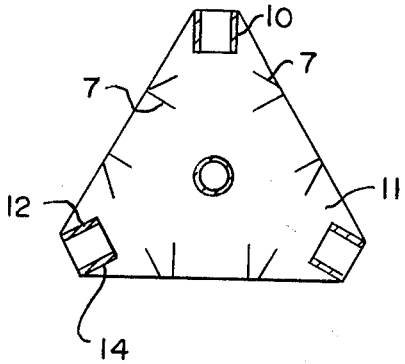
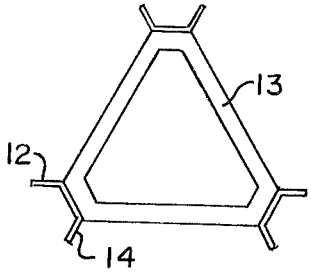
FIG. 3.
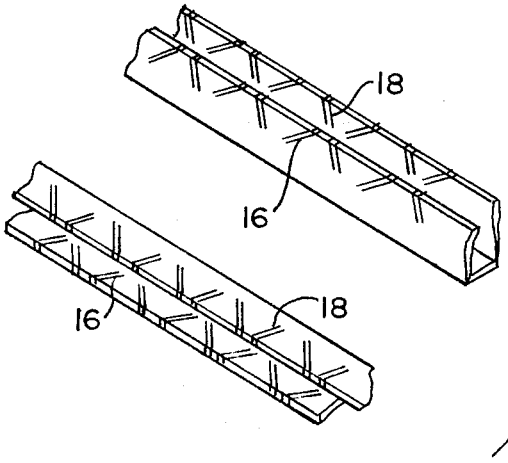
FIG. 4.
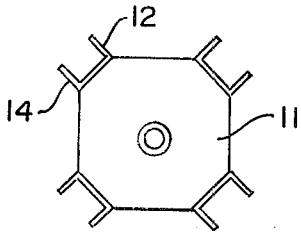
FIG. 5.

STRUCTURAL CORES AND THEIR FABRICATION

BACKGROUND OF THE INVENTION

This invention is concerned with constructional elements, known generally as structural cores, which replace constructional cores of the honeycomb type.

Structural cores are the subject of several U.S. Pat. Nos. such as 3,689,345, 3,813,273 and 3,642,566. These cores are in the form of open-ended polyhedrons joined together along common edges or sides. Such structural core media are generating high industrial interest because of the great strengths they possess relative to their weights. Aircraft constructional cores, for example, must possess quasi-isotropic load-carrying capabilities, including tension, compression, bending and torsional rigidity. Structural core media thus have many uses in the aircraft and other fields.

The structural core medium with which this invention is concerned is similar to that described in U.S. Pat. Nos. 3,645,833 and 3,657,059. Described in those patents is a core of interwoven fibrous filaments coated with plastic to make the core medium. The ultimate core medium is highly satisfactory. However it has the disadvantage that it is very difficult, if not heretofore impossible to produce in other than planar, sandwich or cylindrical form. Whereas an airfoil shape can be made (U.S. Pat. No. 3,645,833) it has not been possible to make polyhedrons with tetrahedral core surfaces. The jig did not exist. We have now made possible the fabrication of such polyhedrons.

SUMMARY OF THE INVENTION

A method is provided herein for producing a polyhedron each side of which is a unitary structural core in the form of a series of symmetrical tetrahedrons arranged in longitudinal rows, each row of tetrahedrons being in offset sequential relation to the tetrahedrons in an adjacent row. Two sides of all tetrahedrons are disposed in oppositely inclining, parallel planes, and the remaining sides are disposed in parallel longitudinal planes with all planes intersecting along a line extending from an apex of the base of each tetrahedron to its apex. The polyhedron is fabricated by interweaving a plurality of fibrous filaments upon each other over a jig and coating the interwoven filaments with a plastic to form the polyhedron.

The jig for producing the polyhedral structural core is in the form of a plurality of channel members with end truss members securing one channel member to another. The flanges of the channel members are directed outwardly, forming an open structure which if closed would be a polyhedron having the outwardly directed channel members as polyhedral edges. The flanges of each channel member are provided with a plurality of alternately sloping slots. The end truss members are provided with sloped slots.

DETAILED DESCRIPTION OF THE INVENTION

Although quasi-isotropic structural cores in the form of rows of tetrahedrons possess more desirable strength properties than conventional honeycomb constructural cores, their use has been limited to layered or sandwiched members. Conical, cylindrical and pyramidal components, that is bodies of revolution, have been difficult to construct of tetrahedral structural cores.

This invention relates to such structures. As will be better understood from the accompanying drawings, polyhedrons having sides in the form of a series of tetrahedrons pointed upwardly and downwardly in alternate sequential relation can be fabricated by means of a special jig.

FIG. 1 is a perspective view of this jig.

FIG. 2 is an end view of the jig of FIG. 1.

FIG. 3 is an end view of another jig embodiment.

FIG. 4 is a cutaway view showing the slots generally employed in a jig like that of FIG. 1.

FIGS. 5, 6 and 7 are cross sectional views of four, six and eight sided jigs.

Referring first to FIG. 1, a jig 2 is shown for use in fabricating a polyhedron with a triangular cross section which will have tetrahedral or frusto tetrahedral sides. The sides will be formed by winding filaments in slots 4 and 6 as will be described, the winding being subsequently plastic coated.

Figure 6:
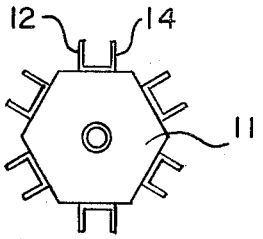
Figure 7:
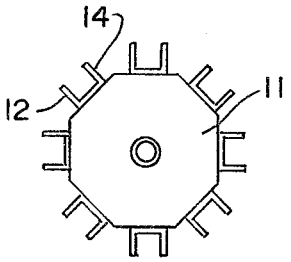

As shown in FIGS. 1 and 2 jig 2 is constructed of trusses 8 and U-frames or channels members 10. Channel members 10 form the skeleton, which defines the sides of the polyhedron. For instance, four channels form a polyhedron with a quadrilateral cross section as shown in FIG. 5. From six channel members a polyhedron with a hexagonal cross section can be formed (FIG. 6); and if eight channel members are employed the result is polyhedron with an octagonal cross section (FIG. 7). The number of channel members 10 thus determines the number of sides of the resulting polyhedron.

As is apparent in the drawings, the channel members 10 form the vertexes of the polyhedral angles. More specifically, considering a polyhedron to consist of faces connected one to another at their edges, the channels form the edges, and the filament-formed tetrahedrons form the faces. It is understood, however, that the channel members must be so disposed that the winding of the filaments thereon can be accomplished. By definition a channel consists of a web and two flanges. The filaments must be wound on the flanges. The channel members must, then, be disposed in the polyhedral skeleton, or jig, with their flanges 12 and 14 directed outwardly as shown in FIGS. 5 thru 7. Channel members 10 desirably will all be the same length. And they can be held in their respective positions by any number of truss members 8, in the form of end plates 11, or straps, bars or rods 13. Although truss members can be used at points other than at the channel member ends, sufficient strength will generally result from the tetrahedral sides of the polyhedron so that other than end trusses are not necessary.

Figure 8:
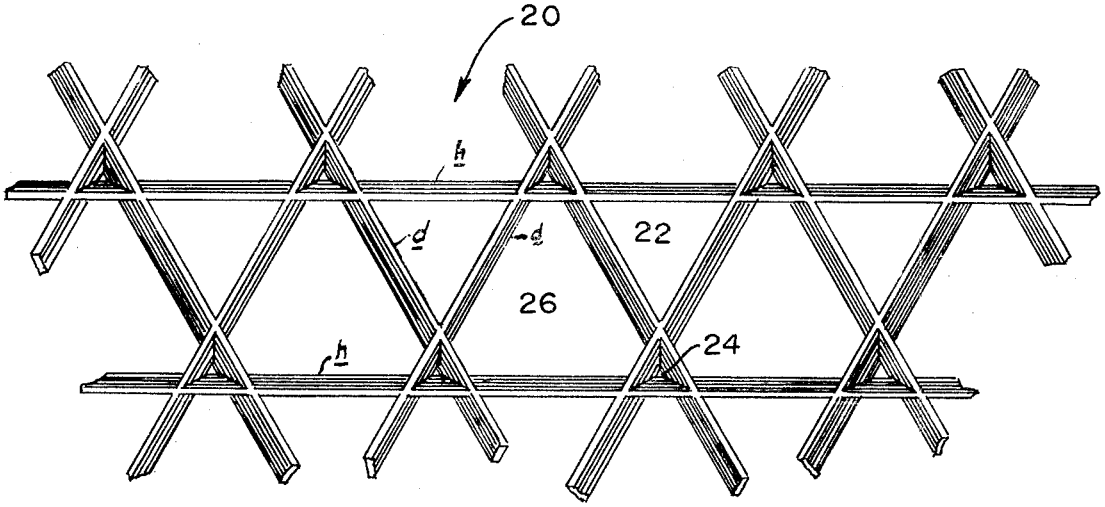
FIG. 8 shows the filament winding.

As indicated the polyhedron is produced by winding fiber filaments through slots in channel member flanges 12 and 14 of jig 2. In order that this can be accomplished flanges 12 and 14 of jig 2 are provided with slots 4 and 6, and the truss members with slots 7. The number and spacing of slots obviously determine the size of the open spaces between filament rows (FIG. 8). Thus the structural core element 20 shown in FIG. 8 consists of a series of truncated polyhedrons 22, 24, 26 which vary in size according to the geometry of the slots. In addition since jig 2 is tapered, the truncated polyhedrons will be smaller near the smaller end of the jig. In general since filament rows form tetrahedrons, the number of slots determine the size of the tetrahedrons. The height of the tetrahedrons, and whether they will be complete or frusto tetrahedrons will be determined by the height of the flanges, and the orientation of the slots. The orientation of the tetrahedrons will be determined by the angles the flanges of the channels make with the web or base. The flanges can be approximately parallel, convergent or divergent depending upon the number of U-channels in the jig, and upon the desired geometry of the tetrahedrons formed.

Having described the jig, we will now proceed to the winding of the filaments thereon to form the tetrahedral faces of the polyhedron (FIG. 8). Each side of the polyhedron of the invention will have a face similar to that shown in FIG. 8. In the special case of the polyhedron with a triangular cross section (FIG. 1), one flange of each channel is provided with a plurality of alternately sloping slots 4, whereas the other flange of each channel is provided with a plurality of upright slots 6. More simply stated, vertical slots 6 are cut along the length of one of the upstanding legs of the U-channel of FIG. 1, and inverted V-slots 4 in the other. The angles of these slots and the spacing of these slots dictate both the dimensions of the structural core and the slope of the structural core walls. These slots position the roving during the winding process. They are of correct dimensions (having widths equal to roving size) to insure stacking, and so that their lengths will determine the heights of the tetrahedrons. The filaments are wound in an helical pattern, that is, from one channel member 10 to the next channel member in one direction, from slot to appropriate slot (depending upon pattern) along the length of each channel member 10 toward its end. From slots 4 or 6 near the ends of channel member 10 fibers are passed out through a slot 7 in truss member 8 (FIG. 1), or end plates 11 (FIG. 2), across the back to a second slot 7 and back through the end plate 11 to the channel member slot. The winding of the pattern is then begun in the other direction. This process is repeated until one complete face of modified tetrahedrons (FIG. 8 but of any desired planform angle) has been wound. Due to the nature of the winding operation (i.e., every slot is not used in one pass/circuit) the resulting structural core product is not totally layered as in our prior patents. In this case, the cross axis fibers are woven with the mutual cross axis fibers in a given layer of the product as a function of the number of slots.

The winding pattern can be such that the fiber advances more than a single slot as it traverses from one channel member 10 to the next in the direction of the winding, forming a diagonal plane d. In winding the polyhedron with a preferred triangular cross section the fiber advances six slots in going from one channel member to the next. This pattern results in some degree of weave. As the pattern is filled in, some fibers are alternately over and under the fibers in the neighboring layers. The pattern is not repeatable from side to side. In other words if the winding advances by skipping slots which are included later in the process the pattern is a weave. By a weave we mean the same filament is not always on the bottom, or second, etc. throughout the structural member. If the winding is done from slot to slot so that the slots are sequentially filled with the fibers a layered arrangement in the structural member results, rather than a woven arrangement. By layered we mean that the bottom filament is on the bottom throughout; the third filament is third throughout the structure, etc. Referring further to the winding process it can be seen that cutting across the diagonal planes d are horizontal planes h (FIG. 8). Slots 7 in end plates 8 or 11 are necessary for the generation of these horizontal planes h, and it is these planes h which confer the third axis strength on the structural member.

In the fabrication of the polyhedrons using the jigs of FIGS. 5, 6 and 7 the upright or vertical slots will not be used. Ideally one flange of each channel will have inverted V-slots and the other flange of each channel will have offset inverted V-slots. In other words the slots in both flanges will be inverted V-slots those in one flange being offset from inverted V-slots in the other flange. If frusto tetahedral sides are fabricated the slots will not be V-slots, but alternately sloping slots. In the embodiment of FIG. 4, for instance, one flange is provided with alternately sloping slots 16, and the other flange is its mirror image, due to the orientation of slots 18. The end truss members will be provided with sloped slots in any event.

In the winding of the filaments, consider the intersection of two intersecting planes which are not vertically disposed. Consider also the sectional view generated by a nonvertical cutting plane thru the vertex. If the two planes slope so that their top edges are closer than their bottom edges, this sectional view will be an inverted V. If the two planes slope so that their bottom edges are closer than their top edges the sectional view will be an upright V. The disposition of the truncated tetrahedrons forming the structural core herein are such that the intersecting section at one channel is an inverted V whereas the intersecting section at the other channel is an upright V. It was found in the case of the jig of FIG. 1, however, that instead of upright V-slots, vertical slots could be used for the windings. The vertical slot, in effect, is the line of intersection of the two planes. In the general case each flange will be provided with a plurality of alternately sloping slots. The orientation of the slots, their slope, depth and distance apart and the flange angles will determine the geometry of the tetrahedrons formed by the windings. Desirably the slots in one flange will be offset, relative to the slots in the opposite flange.

Figure 9:
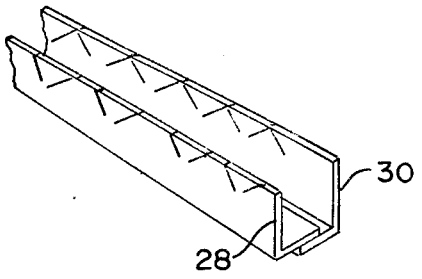
FIGS. 9 and 10 show a different form of channel member.
Figure 10:
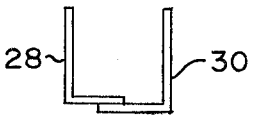

It can be seen from the foregoing that this invention is amenable to all parallelepiped structures, or regular or irregular three dimensional polyhedrons, with or without taper (any body of revolution). Either flat or positively curved shapes can be achieved between the U-channels by placing appropriately shaped supporting panels between the channels. The windings will lay against these panels. Both single and compound positive curvature can be obtained. The U-channels can be made from any structural material. In addition other modifications will occur to those skilled in the art. Thus, to reduce the difficulty of cutting the slots in the channels (since the slot pattern is not symmetrical from side to side) the U-channel can be fabricated as two L-sections 28 and 30 as shown in FIGS. 9 and 10. The slots can then be cut prior to assembly into the U-channel.

As another example it may be desirable that the jig become part of the ultimate three dimensional structure. In this case it will not be removed. When removed a polyhedron fabricated solely of tetrahedrons will result. Similarly the plastic used to coat the filaments, and the selection of the filaments themselves, will be governed by desired strength properties. Thus where heat is a factor thermoplastic resins will not be used to coat the filaments. Thermosetting resins are preferred, and virtually any thermosetting resin can be employed. Therefore epoxide resins, aminoplastics, polyamides, ionomers, and phenol-aldehydes are all desirable. Thermoplastic resins will be those such as polyolefins, phenylene oxides and polyarylethers.

Since the positioning of the jig channel flanges determines the orientation of the planes of the tetrahedrons forming the sides of the polyhedron a wide latitude of flange angles (with the web) are permissible. The flanges can be parallel, directed inwardly, outwardly or skewed. Thus the geometry is determined by the slots. The plane angles are determined by the flanges. And the polyhedron is determined by the number of channels. Obviously all of these are variables to be chosen by the fabricator. For example if the jig is to have more than say twelve U-channels the tops of the flanges should be directed inwardly. In the case of a four sided jig the channel flanges may be directed outwardly. In still another embodiment the channels need not be parallel. Pyramidal polyhedrons can be fabricated by using nonparallel channels in the jig. Such ramifications and others will occur to those skilled in the art. Such variations are deemed to be within the scope of this invention.

What is claimed is:

1. A jig for producing polyhedral structural cores from fiber filaments by winding the filaments thereon comprising three or more channel members, each with two flanges, end truss members securing one channel member to another with flanges of the channel members directed outwardly forming an open structure which if closed would be a polyhedron having the outwardly directed channel members as polyhedral edges, with the number of channel members defining the number of sides of the polyhedron, a plurality of alternately sloping slots through one flange of each channel member, a plurality of slots through the other flange of each channel member, and a plurality of slots through the end truss members.

2. The jig of claim 1 wherein the channel members are held by the truss members so that they are parallel to each other.

3. The jig of claim 1 wherein the channel members are held by the truss members so that they are not parallel to each other.

4. The jig of claim 1 wherein there are four channel members.

5. The jig of claim 1 having a plurality of inverted V-slots through each flange of each channel member, the plurality of inverted V-slots through one flange being offset relative to those through the other flange.

6. The jig of claim 1 wherein there are three channel members.

7. The jig of claim 6 wherein the alternately sloping slots in one channel are offset relative to the sloping slots in the other flange.

8. An article of manufacture fabricated by interweaving fibrous filaments over the jig of claim 1 to form a polyhedron each side of which is a noncurving unitary structural core of interwoven fibrous filaments, plastic coated to form a series of symmetrical tetrahedrons arranged in longitudinal rows, each row of tetrahedrons being in offset sequential relation relative to the tetrahedrons in an adjacent row, whereby two sides of all tetrahedrons are disposed in oppositely inclining, parallel planes and the remaining sides are disposed in parallel longitudinal planes, all planes intersecting along a line extending from an apex of the base of each tetrahedron to its apex.

9. The article of claim 8 wherein the polyhedron is a trihedron.

10. The article of claim 8 wherein the polyhedron is a quadrahedron.

11. The article of claim 8 wherein the polyhedron is a hexahedron.

12. The article of claim 8 wherein the polyhedron is a octahedron.

13. A method of making a polyhedron whose sides are structural core members in the form of longitudinal rows of tetrahedrons which comprises interweaving fibrous filaments in a helical pattern from slot to slot over the jig of claim 1 whereby the filament rows mounted on top of each other are each offset from the preceding row to form planes that intersect to define the tetrahedrons, and coating said interwoven filament planes with a plastic to form the polyhedron.

14. The method of claim 13 wherein the plastic is a thermosetting resin.

15. The method of claim 14 wherein the thermosetting resin is an epoxy resin mixed with a curing agent.

* * * * *